United States Patent [19]

Gerritsen et al.

[11] Patent Number: 4,734,613

[45] Date of Patent: Mar. 29, 1988

[54] LIQUID COOLED DISPLAY TUBE

[75] Inventors: Gerritt B. Gerritsen; Willem M. Van Alphen, both of Eindhoven, Netherlands

[73] Assignee: U.S. Philips Corporation, New York, N.Y.

[21] Appl. No.: 569,374

[22] Filed: Jan. 9, 1984

[30] Foreign Application Priority Data

Jan. 13, 1983 [NL] Netherlands ..... 8300114

[51] Int. Cl.[4] ..... H01J 29/86; H01J 7/24

[52] U.S. Cl. ..... 313/36; 313/12; 313/44; 313/477 R

[58] Field of Search ..... 313/477 R, 478, 12, 313/36, 44; 358/253, 247, 250; 165/170

[56] References Cited

U.S. PATENT DOCUMENTS

| | | | |
|---|---|---|---|
| 1,955,899 | 4/1934 | Zworykin | 313/36 X |
| 3,914,010 | 10/1975 | Zeller | 313/12 X |
| 4,213,498 | 7/1980 | Vanderbossche | 165/46 X |
| 4,405,949 | 9/1983 | Hockenbrock | 358/237 |
| 4,511,927 | 4/1985 | Bauer | 358/250 |
| 4,529,905 | 7/1985 | Ohkoshi et al. | 313/44 X |

OTHER PUBLICATIONS

*College Chemistry* , by John R. Lewis, p. 314, (1971), published by Barnes & Noble Books.

*Primary Examiner*—Palmer C. DeMeo
*Attorney, Agent, or Firm*—F. Brice Faller

[57] ABSTRACT

An efficiently cooled display tube is obtained by pumping a low viscosity liquid having a high heat capacity through a cooling space less than 1 mm. thick on the outside of the display window. A chamber is smoothly connected to the inlet aperture of the cooling space to assure a laminar flow, eliminating swirls which could give rise to refractive patterns in the display picture.

5 Claims, 2 Drawing Figures

LIQUID COOLED DISPLAY TUBE

BACKGROUND OF THE INVENTION

The invention relates to a display tube comprising an evacuated envelope having a substantially rectangular display window which on its inside comprises a display screen and in front of which on its outside, substantially parallel to the display window, a light-transmitting second window is provided and a light-transmitting cooling liquid flows through the space between the display window and the second window. Such a display tube is known from Netherlands Patent Application No. 8003360 laid open to public inspection. The display screen of such a display tube often comprises a phosphor layer on which a frame is written by means of an electron beam. As a result of the electron bombardment the temperature of the display screen rises so that the luminous efficiency of the display screen decreases. This effect is terminal "thermal quenching". This is the case in particular in display tubes for projection television in which the display screens are scanned by electron beams having large beam currents so as to obtain the required great brightnesses. In order to counteract the reduction of the luminous efficiency it is known from the Netherlands Patent Application No. 8003360 laid open to public inspection to cool the display window and the display screen connected thereto. This is done in the manner described in the opening paragraph. A disadvantage of this way of cooling, however, is that inhomogeneities of the refractive index occur in the cooling liquid which are expressed in refractive patterns in the displayed picture.

SUMMARY OF THE INVENTION

It is therefore an object of the invention to provide a display tube which does not exhibit the disadvantage and in which the thermal capacity of the cooling liquid is used optimally.

For that purpose a display tube of the kind mentioned in the opening paragraph is characterized according to the invention in that the inlet and outlet apertures of the space are situated opposite to each other, have substantially the same dimensions as a cross-section of the space at right angles to the direction of flow, and at least the inlet aperture opens smoothly into a chamber having dimensions which are larger than the spacing between the display window and the second window, said spacing and the viscosity of the cooling liquid being chosen to be so that the flow of the coolant through the space is laminar. This laminar flow has for its advantage that the temperature gradient and hence the density gradient varies homogeneously over the surface of the display window. Because in the space in front of the display window no whirls occur in the cooling liquid which are associated with comparatively great temperature and density gradients, no inhomogeneities of the refractive index of the cooling liquid oocur which give rise to refractive patterns in the displayed picture (the so-called Schlieren effect). A laminar flow of the cooling liquid is obtained if the spacing between the display window and the second window is preferably smaller than 1 mm. The lower limit of the spacing between the display window and the second window is determined only by the accuracy with which it is possible to make a narrow space. This depends inter alia on the smoothness of the display window and the second window (10à20 μm).

In order to obtain an efficient cooling, it is necessary to use a cooling liquid having a high heat capacity and a comparitively low viscosity. It is especially the low viscosity which gives rise to the whirls when an inlet aperture has not been constructed carefully. Therefore, the inlet flow and preferably also the outlet flow of the cooling liquid must occur smoothly so as to prevent whirls.

An advantage of such a thin layer of cooling liquid over a thicker one is that influences of differences in the refractive indices of the cooling liquid, the material of the display window and the material of the second window are much smaller than in the case of a thicker layer. For a spacing of approximately 300 μm between the display window and the second window, the layer of cooling liquid is so thin that it is not necessary to adapt the refractive indices to each other. Less viscous cooling liquids, for example water or a water-alcohol mixture, are possible instead of the so far used syrupy ethylene glycol solutions in water.

In projection television, an object displayed on the display screen is displayed on a projection screen by means of a lens or a system of lenses. An advantage of the use of a display tube in accordance with the invention is that as a result of the comparatively thin layer of liquid the first component of the system of projection lenses can be positioned more closely to the object to be displayed. This is of importance for correction of the display field curvature for which a curved refractive surface immediately near the object surface is required. It is therefore desirable that the spacing between the display screen and the lens should not be larger than 8 to 10 mm. In most liquid cooling systems with natural convection, as described, for example, in the above-mentioned Netherlands Patent Application No. 80 03360 laid open to public inspection and in the article "A new coolant-sealed cathode ray tube for projection color t.v.", I.E.E.E. Vol. CE-27, No. 3, Aug., 1981, the layer of liquid alone is already 5 mm thick or more.

When the second window is the first component of a system of lenses an optical coupling between the system of lenses and the display tube is obtained in a simple manner in addition to a good cooling.

When the second window consists of X-ray absorbing glass it is possible for the display window to be constructed thinner than the usual 8 mm because the X-ray absorption of the display window may then be smaller.

In a display tube in accordance with the invention a very efficient cooling is produced. In the case of a cooling liquid flow, for example, a water-alcohol mixture, of approximately 5 $cm^3$/sec (0.3 l/min) a power of approximately 100 W can be dissipated. This results in a rising temperature of the cooling liquid of approximately 5° C. For example, in order to obtain the same cooling capacity with air, an air flow along the display window is necessary of approximately 17.5 l/sec.

With a constant volume flow of the cooling liquid a comparatively small spacing between the display window and the second window has for its advantage that the flow rate along the display window is much larger than when the spacing is large. For a cooling liquid flow of 5 $cm^3$/sec and a spacing between display window and second window of 300 μm, and said speed for a 6" tube is approximately 17 cm/sec. As a result of such high speed, an equilibrium condition very rapidly adjusts. In display windows having a thickness of 8 mm and cooling with laminar flow, an equilibrium state was established within two minutes. In the known projection television systems with convection cooling, as described in the Netherlands Patent Application No. 80 03360 laid open to public inspection and in the article "A new coolant-sealed c.r.t. for projection color t.v.", the adjusting of an equilibrium condition takes much longer, for example 30 minutes.

In the example described with a 300 μm (0.3 mm) thick cooling liquid layer in a 6" tube, the dissipation as a result of the viscous flow is only approximately 10 mW. In the case of air cooling, a dissipated energy of more than 3 Watt would be necessary with a spacing between the display window and the second window of 1 cm so as to obtain the same cooling capacity. Said energies are the losses in the system to be cooled. Losses occur in addition in fans and filters which are necessary for air cooling. Cooling with a laminar liquid flow according to the invention hence is energetically more favorable than air cooling.

Analysis of the heat transfer to the laminar cooling liquid flow demonstrates that only for a thin cooling liquid layer the thermal capacity of the circulating coolant is used optimally. When a layer of cooling liquid is thick (a few mm), the thermal energy of the display window is dissipated only in a thin layer immediately in front of the display window and the greater part of the cooling liquid flows through the space between the display window and the second window unheatedly.

Experiments have demonstrated that it is not only the phosphor that needs to be cooled but also the display window of the display tube. Air-cooled display tubes having a forced air flow can be operated only to approximately 10 to 15 Watts beam power and tubes having convection cooling up to approximately 20 Watts. Tubes having laminar liquid flow cooling can be operated without danger for fracture up to powers of 60 to 80 W because said very efficient cooling results in an isothermally flat temperature distribution over the display screen. The temperature distribution and the associated stress in the glass in these tubes are determined only by the thermal conductivity of the glass of the display window, the thickness of the display window and the quantity of thermal energy to be dissipated. Thin display windows are therefore to be preferred over the usual thick display windows having a thickness of approximately 8 mm. As already said, the reduced X-ray absorption in a thin display window can be taken over by X-ray absorbing glass of the second window.

Experiments with tubes in accordance with the invention having display screens of the usual phosphors, for example willemite (Zn, $SiO_4$:Mn) and $Y_2O_3$:Eu, demonstrate that cooling has no great influence on the efficiency of the phosphors. It is possible to use much larger beam currents in the display tubes than is usual and to obtain in this manner a much greater picture brightness.

In the case of a cooling with laminar flow of the cooling liquid in accordance with the invention, the cooling liquid has the highest speed in front of the display window so that there are few problems with air bubbles and impurities. Elsewhere in the cooling circuit the flow rate is much lower as a result of a larger cross-section of the cooling duct, as a result of which impurities, if any, precipitate.

By using the liquid cooling, the display window can be grounded by condition of the cooling liquid so that no problems with electrostatic charges and dust in the light path occur.

In contrast with convection cooling in which the display tubes with the display screen have to be arranged vertically, the display tubes according to the invention may be mounted in any position. This is of importance to obtain small projection television devices.

BRIEF DESCRIPTION OF THE DRAWINGS

The invention will now be described in greater detail, by way of example, with reference to a drawing, in which.

DESCRIPTION OF THE PREFERRED EMBODIMENTS

Figure 1:
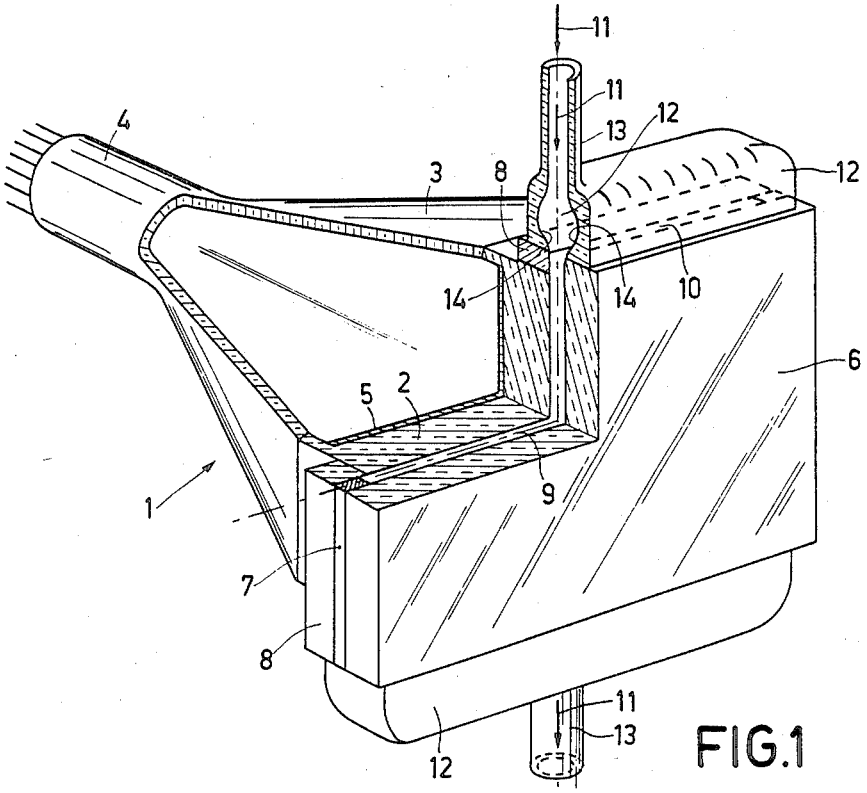
FIG. 1 is a perspective view, partly broken away, of a display tube according to the invention.

FIG. 1 is a perspective view, partly broken away, of a display tube according to the invention. The glass envelope 1 comprises a substantially rectangular display window 2, a cone 3 and a neck 4. Present in the neck 4 are means (not visible) for generating at least one electron beam which is deflected during operation of the tube and which describes a frame on a display screen 5 on the inside of the display window 2. The display screen 5 consists of a phosphor or of a pattern of different phosphor areas. A second window 6 is provided parallel to the display window 2 by means of parallel seals 7 which engage a collar 8 provided around the display window. A space 9 through which the cooling liquid flows is present between the display window 2 and the second window 6. The spacing between the display window 2 and the second window 6 is 300 μm. The inlet and outlet apertures 10 (only the inlet aperture is shown) have substantially the same dimensions as a cross-section of the space 9 at right angles to the directions of flow which is indicated by arrows 11. The inlet and outlet apertures 10 open into chambers 12 of inlet and outlet devices comprising inlet and outlet pipes 13. The chambers 12 (especially the chamber near the inlet aperture) which are connected in a smooth manner to the inlet and outlet apertures are necessary for the correct hydrodynamic inlet and outlet of the cooling liquid flow. The smooth connection is obtained by giving the walls 143 approximately the shape according to the flow lines in the liquid. Said chambers 12 have dimensions which are larger than the spacing between the display window 2 and the second window 6.

Figure 2:
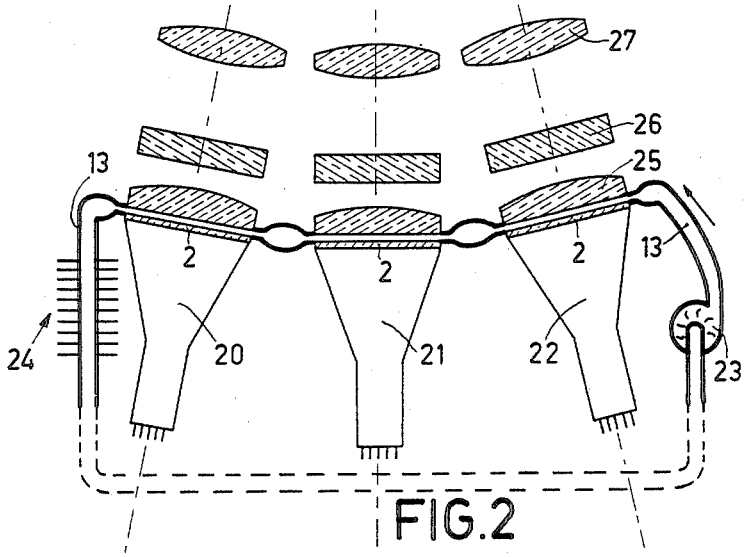
FIG. 2 shows diagrammatically a colour television projection device.

FIG. 2 shows diagrammatically a colour television projection system. It comprises three display tubes 20, 21 and 22 shown in FIG. 1. The inlet and outlet pipes 13 of the three tubes are interconnected in such manner that the spaces through which the cooling liquid flows are connected in series with each other. The cooling liquid circulated by means of a pump 23 is cooled in a cooler 24. Because the display window 2 is rather thin, it insufficiently absorbs the X-ray radiation generated in the display tubes. Therefore, the second window 24 and/or one of the lens components 26, 27 is manufactured from a glass which is X-ray absorbing.

I claim:

1. A display tube comprising an evacuated envelope in which an electron beam is generated a substantially rectangular display window having an inside surface in said envelope and an opposed outside surface, said inside surface having a display screen thereon, a light transmitting second window outside of said envelope substantially parallel to said outside surface of said display window, a light transmitting cooling liquid flowing between said display window and said second window a substantially rectangular space through which said cooling liquid flows between said windows, said space having a depth defined by the spacing between said windows, said spacing being less than 1 mm, said space having opposed inlet and outlet apertures, said apertures having substantially the same dimensions as a cross section of said space at right angles to the direction of flow, a chamber having dimensions exceeding the spacing between said windows, said inlet aperture opening smoothly into said chamber, whereby, the influence of different refractive indices between the cooling liquid and said windows is small.

2. A display tube as in claim 1, wherein the cooling liquid is a low viscosity liquid.

3. A display tube as in claim 2, wherein the cooling liquid is an alcohol-water mixture.

4. A display tube as in claim 2, wherein the cooling liquid is water.

5. A display tube as in claim 1, wherein said second window is spaced about 0.3 mm from said display window.

* * * * *